US011577936B2

(12) United States Patent
Rocher et al.

(10) Patent No.: US 11,577,936 B2
(45) Date of Patent: Feb. 14, 2023

(54) ELEVATOR APRON

(71) Applicant: Otis Elevator Company, Farmington, CT (US)

(72) Inventors: Jean-Emile Rocher, Lorris (FR); Etienne Billant, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 161 days.

(21) Appl. No.: 17/060,583

(22) Filed: Oct. 1, 2020

(65) Prior Publication Data

US 2021/0101785 A1 Apr. 8, 2021

(30) Foreign Application Priority Data

Oct. 4, 2019 (EP) ..... 19306292

(51) Int. Cl.
*B66B 13/28* (2006.01)

(52) U.S. Cl.
CPC ..... *B66B 13/285* (2013.01)

(58) Field of Classification Search
CPC ..... B66B 13/28; B66B 13/285
See application file for complete search history.

(56) References Cited

U.S. PATENT DOCUMENTS

| | | | | | |
|---|---|---|---|---|---|
| 734,225 | A * | 7/1903 | Fisk et al. | B66B 17/18 | 187/400 |
| 858,390 | A * | 7/1907 | Hillebrand | B66B 17/18 | 187/400 |
| 1,022,972 | A * | 4/1912 | Ross | B66B 13/285 | 187/400 |
| 1,741,941 | A * | 12/1929 | Jacobson | B66B 13/285 | 49/70 |
| 2016/0122159 | A1* | 5/2016 | Delachatre | B66B 13/285 | 187/400 |
| 2020/0031629 | A1* | 1/2020 | Bruno | B66B 9/00 | |

FOREIGN PATENT DOCUMENTS

| | | | | | |
|---|---|---|---|---|---|
| DE | 202007013602 | U1 | | 2/2009 | |
| EP | 2138443 | A1 | | 12/2009 | |
| EP | 3560879 | A1 | * | 10/2019 | B66B 11/02 |
| JP | 2000118930 | A | * | 4/2000 | B66B 13/285 |
| JP | 2004099183 | A | * | 4/2004 | B66B 13/285 |
| JP | 2006264809 | A | * | 10/2006 | B66B 13/285 |
| JP | 2018034927 | A | * | 3/2018 | |
| KR | 102320728 | B1 | * | 11/2021 | B66B 13/08 |

OTHER PUBLICATIONS

European Search Report for Application No. 19306292.4; dated Apr. 17, 2020; 5 Pages.

* cited by examiner

*Primary Examiner* — Minh Truong
(74) *Attorney, Agent, or Firm* — Cantor Colburn LLP

(57) ABSTRACT

An elevator car including: a door; and an apron movable between a deployed position and a retracted position; wherein in the deployed position the apron hangs below the door; wherein in the retracted position the apron is vertically overlapped with the door; and wherein in the retracted position the apron is engaged with the door such that it is movable sideways together with the door. As the apron is displaced upwards relative to the elevator car it will block the doorway. However, as the apron is engaged with the door in the retracted position, opening the door also moves the apron out of the way of the doorway so that the apron does not hinder passengers from using the elevator car.

13 Claims, 6 Drawing Sheets

ELEVATOR APRON

FOREIGN PRIORITY

This application claims priority to European Patent Application No. 19306292.4, filed Oct. 4, 2019, and all the benefits accruing therefrom under 35 U.S.C. § 119, the contents of which in its entirety are herein incorporated by reference.

TECHNICAL FIELD OF INVENTION

The present disclosure relates to elevator aprons (also referred to as toe guards) which protect against passengers falling into the hoistway during passenger rescue operations, in particular this disclosure relates to aprons for use in elevator systems with reduced depth pits (or low profile pits).

BACKGROUND OF THE INVENTION

The apron or toe guard is provided below the entrance (or entrances) of an elevator car and hangs down from the elevator car adjacent to the hoistway wall. When there is a problem with the elevator system and passengers need to be evacuated from an elevator car, a rescue operation may be performed. During such a rescue operation the elevator car may not be fully aligned with the landing entrance but it may still be possible for passengers to exit the elevator car if the elevator doors are at least partially aligned with a landing. If the elevator car has stopped slightly below a landing position then passengers may be able to step up from the elevator car onto the landing above if the landing doors for that landing are opened. If the elevator car has stopped slightly above a landing position then passengers may be able to drop down from the elevator car onto the landing below if the landing doors for that landing are opened. However, in this latter case (dropping down to a lower floor) when the elevator car is not properly aligned with the landing floor, i.e. when the elevator is offset in the hoistway compared with a normal landing position, there is a gap below the elevator car which, when the landing doors are open, provides access into the hoistway. This gap presents a risk to passengers dropping down from the elevator car because if the gap is large enough then a passenger could fall into the hoistway. For this reason elevator cars are often provided with an apron or toe guard that extends for a distance below the elevator car, in close proximity to the hoistway wall where the landing doors are located, thereby closing (or at least partially closing) the gap and reducing or eliminating the risk to passengers when exiting the car in a rescue operation. In many countries an apron or toe guard is required by regulations (e.g. Code EN 8120 requires an apron of length at least 750 mm).

During normal operation the apron is out of sight, simply hanging below the elevator car. When the elevator car is at the lowest floor, the apron hangs into the pit at the bottom of the hoistway. This is not a problem for larger elevator systems with a full size pit. However, in smaller installations the pit can be reduced in height significantly, in some cases down to around 300 mm, i.e. there is only 300 mm of space below the bottom of the elevator car when the elevator car is at the lowest floor. A 750 mm apron cannot fit into this space. Solutions to this problem have included foldable or collapsible aprons that can move or fold out of the way at the lowest floor, but which will deploy to the full 750 mm required length as the elevator car leaves the lowest floor. However such mechanisms add complexity and cost.

SUMMARY OF THE INVENTION

According to a first aspect of the present disclosure there is provided an elevator car comprising: a door; and an apron movable between a deployed position and a retracted position; wherein in the deployed position the apron hangs below the door; wherein in the retracted position the apron is vertically overlapped with the door; and wherein in the retracted position the apron is engaged with the door such that it is movable sideways together with the door.

Allowing the apron to overlap vertically with the door (i.e. such that the door and the apron share an amount of vertical extent or such that a certain height range is occupied by both the apron and the door) means that the apron can be simply displaced upwards when the elevator car reaches the lowest landing and the apron contacts the pit floor. No complex folding mechanism is required to fit the apron within the pit area. As the apron is displaced upwards relative to the elevator car it will block the doorway which would prevent passengers from entering or exiting the car during normal operation (i.e. when entering or exiting at the lowest floor). However, as the apron according to this disclosure is engaged with the door in the retracted (i.e. non-deployed) position, opening the door also moves the apron out of the way of the doorway so that the apron does not hinder passengers from using the elevator car. This arrangement is especially useful in elevators with shallow pits as a full length apron can be used without needing to fold it or rotate it out of the way in order to allow access to the lowest floor.

The apron has sufficient rigidity that it holds its form while it is supported by the pit floor and while the elevator car descends to the lowest floor. The rigidity of the apron may come from the thickness of the material, but can also be affected by adding additional structures to increase rigidity. For example, additional stiffening structures could be added to the apron to increase rigidity. In some examples telescoping stiffeners could be added which provide extra support to the panel by extending as the apron moves to the retracted position. In other examples, the apron could be shaped for increased rigidity, e.g. by adding one or more bends or folds to the apron. In some examples the apron may have a bend at one or both sides, e.g. a right-angle bend. To minimise the space that the apron occupies between the elevator car and the hoistway wall, the bend(s) may be accommodated within the elevator car door sill. In such examples the elevator car door sill may have a vertical slit to accommodate the bend of the apron as it moves vertically between the deployed position and the retracted position. Additionally the apron may have a slit formed in the bend to allow movement past the elevator car door sill during door opening and closing when the elevator car is at the lowest floor (and the apron is in the retracted position). The position of the slit in the bend of the apron will be determined by the depth of the pit so that it aligns with the sill.

When the elevator car is not at the lowest floor (and when it leaves the lowest floor) the weight of the apron causes it to move to the deployed position where it provides its normal function, hanging below the elevator car and obstructing access to the hoistway in the event of a rescue operation in which passengers need to be helped down to a lower landing. The apron may move from the retracted position to the deployed position under gravity alone, i.e.

based solely on the weight of the apron. Additional weight (e.g. filler material) may be added to the apron if desired to ensure reliable deployment.

When the apron is in the retracted position it is moved sideways when the elevator car door is opened and therefore does not perform its function of obstructing access to the hoistway. However, as this only ever happens when the elevator car is at the lowest floor and when the apron is in contact with the pit floor, the access to the hoistway is not a severe risk.

It should be noted that this only applies at the lowest landing, adjacent the pit. At all other landings there is plenty of room below the elevator car for the apron to hang in its deployed position under the elevator car door. Thus in the deployed position the apron may be disengaged from the elevator car door such that it will not move sideways together with the elevator car door. Therefore in the event of a rescue operation being required, the elevator car door can be opened without moving the apron so that the apron performs its function of obstructing the opening onto the hoistway and reducing the risk to passengers and/or rescuers.

The elevator car door can take many different forms. For example a single sliding door panel that opens to one side is viable. So long as there is room for the door to slide out of the way there will also be room for the apron to be moved out of the way. However, in most elevators the space for door opening is constrained and therefore elevator car doors tend to have at least two panels. The two most common types of elevator doors are centre-opening doors and telescoping doors. In centre-opening doors one panel slides open to one side while the other panel slides open to the opposite side. In telescoping doors both panels (or indeed three or more panels) slide to the same side of the doorway but are offset so that they can slide past each other (i.e. so that the panels substantially fully overlap with each other when the door is fully open). Of course a centre-opening door is possible in which both sides feature a telescoping arrangement.

Therefore in some examples the elevator car door comprises a first door panel and a second door panel and the apron comprises a first apron panel and a second apron panel; wherein in the retracted position the first apron panel is vertically overlapped with the first door panel and the second apron panel is vertically overlapped with the second door panel.

In such arrangements the apron is split into two (or more) separate panels, each arranged to move with a different door panel. In this way the apron panels can be moved into the same horizontal spaces as the door panels, thereby ensuring that there is always sufficient horizontal space to accommodate the apron in the retracted, door-open position. In this regard it may be noted that in cases where there is a wide hoistway and/or a wide pit, the apron could be kept as a single panel and arranged to move with one of the door panels. A slightly more complex engagement mechanism may be required in such examples to ensure that the apron moves fully out of the doorway, but such examples are still viable.

In some examples the first apron panel is arranged such that when it is in the retracted position it moves sideways together with the first door panel, and the second apron panel is arranged such that when it is in the retracted position it moves sideways together with the second door panel.

As discussed above, the elevator car door may be a centre-opening door in which the first door panel is movable to one side of the elevator car and the second door panel is movable to the other side of the elevator car during door opening.

Also as discussed above, the elevator car door may be a telescoping door in which the first door panel and the second door panel are movable to the same side of the elevator car during door opening.

The apron can be arranged to overlap with the elevator car door in different configurations. For example the apron could be arranged to overlap on the outside of the elevator car door (i.e. between the elevator car door and the landing door). It will generally not be preferred to have the apron overlap with the elevator car door on the inside of the door as this could cause a hazard to passengers, although in cases where an additional protection was in place this could also be viable. However, in some examples in the retracted position the apron is disposed at least partly inside the elevator car door. Thus the apron overlaps with the door by extending upwards inside the door, i.e. inside a cavity of the door. This is a particularly space efficient arrangement which does not require any additional space to be designed in between the elevator car doors and the landing doors. It also prevents the apron from catching on anything on the outside of the elevator car door when it is moved into the retracted position. Also, as the apron is often conveniently arranged to hang from the door sill when it is in the deployed position and as the door sill is located directly under the door, this arrangement is particularly convenient.

In some examples in the deployed position the apron hooks onto a door sill underneath the door. The apron may therefore in some examples have one or more hooks or lips formed at the top edge thereof which can rest or hook onto the sill. The apron is thus held in the deployed position in which it hangs below the elevator car door, but can be lifted clear of the sill in order to move to the retracted position (e.g. through contact with the pit floor while the elevator car continues to descend).

In some examples the elevator car door comprises a first engagement part and the apron comprises a second engagement part arranged to engage with the first engagement part when the apron is in the retracted position such that movement of the elevator car door in either horizontal direction causes corresponding movement of the apron. The first and second engagement parts could take a number of different forms. For example one engagement part could be a roller while the other engagement part is a slot (preferably a vertical slot) such that the roller is arranged to roll into and out of the slot. With the roller located within the slot, movement of either the roller or the slot could cause movement of the other in either direction (a relatively tight fit is preferred with little or no play so as to ensure the two parts move in unison). In other examples two rollers could be arranged to engage either side of a flange. With each roller arranged to engage the flange and remain in contact therewith, the two parts would move in unison. In yet further examples a flange could engage within a slot. It will be appreciated that these examples are given by way of example only and are not intended to be limiting. In each case, it is not important which engagement part is attached to the door and which is attached to the apron. Both possibilities are equally functional.

In some examples one of the first engagement part and the second engagement part comprises a pin and the other of the first engagement part and the second engagement part comprises a horizontal groove interconnected with a vertical groove; wherein the pin is slidably mounted in the grooves such that when the apron is in the deployed position the pin slides within the horizontal groove and such that when the apron moves between the deployed position and the retracted position the pin slides within the vertical groove. The horizontal groove essentially decouples the apron and the door, allowing relative movement of the door and the apron (specifically allowing movement of the door while leaving the apron in place in its deployed position), thereby allowing normal operation of the elevator doors without movement of the apron and ensuring that the apron stays in the deployed, protective position if the elevator doors are opened during a rescue operation at any floor other than the lowest floor. The vertical groove allows the relative movement of the apron and the door when the elevator car approaches the lowest floor and the apron contacts the pit floor. As the elevator car continues to move downwards after the apron has contacted the pit floor, the pin slides within the vertical groove and the apron and door begin to vertically overlap. The vertical groove also provides the engagement means by which to move the apron together with the elevator car door. While the pin is located within the vertical groove, horizontal movement of one part will cause corresponding movement of the other part. Thus as the door opens at the lowest floor, the apron is moved with the door so as to allow passengers to enter and exit the car. Equally, as the door closes, the apron is moved back in front of the doorway so that when the elevator car leaves the lowest floor the apron is deposited back in its deployed and protective position.

The horizontal groove and the vertical groove could be formed in the apron with the pin being formed in or attached to the door. Equally the pin could be formed on or attached to the apron while the groove is formed in the elevator door.

The grooves (both horizontal and vertical) may be formed as troughs or depressions in the surface of the relevant component (i.e. not through-holes), or they may be formed as cuts or apertures (i.e. through-holes).

The pins and grooves should ideally be sized so as to accommodate a small amount of misalignment during use. Such misalignments are not expected to be very large as the weight of the apron will determine alignment with the horizontal groove in a very repeatable manner and door positioning is generally controlled accurately such that alignment with the vertical grooves is likely to be quite accurate. Nevertheless, to accommodate some misalignments the horizontal and vertical grooves may be interconnected via rounded corners or chamfered connections (i.e. such that the grooves are wider at the intersection, tapering to a narrower width away from the intersection) so that any misalignment is accommodated at the intersection and the pins are guided by the rounded corner or chamfer into the appropriate groove during the early stages of relative movement.

In some examples, one engagement part is provided on the apron and the other engagement part is provided on a guiding plate attached to the elevator door. The guiding plate may extend below the bottom of the elevator door. This is advantageous as the apron may, in its deployed position, be located fully below the elevator door (i.e. with no vertical overlap therewith). The guiding plate can provide that overlap so that the engagement parts can be engaged even before any overlap has occurred. Another advantage is that the overlap between the apron and the guiding plate can ensure the verticality of the apron during its retraction and during door opening at the lowest floor.

In some examples the horizontal groove and the vertical groove are formed in the guiding plate attached to the elevator car door.

The guiding plate may be attached to the front of the elevator car door, i.e. to the side of the door that faces the landing, where it will not be visible to passengers. In other examples the guiding plate may be attached inside the elevator car door.

In some examples rollers are provided between the bottom of the apron and the pit floor. Such rollers can reduce the friction and also the noise that would otherwise occur as the apron (which would otherwise be in direct contact with the pit floor) is dragged across the floor. The rollers greatly reduce the friction and noise and put less strain on the door motor. The rollers may be attached to the bottom of the apron so that they travel with the apron and do not obstruct work in the pit. Alternatively the rollers may be provided on the pit floor so that they do not need to be carried by the elevator car.

The elevator car may further comprise a rigid support structure extending downwardly from the bottom of the elevator car adjacent to the apron to provide support and rigidity to the apron in the deployed position, the rigid support structure extending downwardly from the elevator car by a distance less than 300 mm (or less than the depth of the pit). The rigid support structure provides support to stop the apron from swinging or hanging out of its protective position when it is in the deployed position. The majority of the rigidity is provided by the apron and therefore the support structure can be kept to a short length, specifically shorter than the pit depth even in the case of shallow pits. A support of less than 300 mm is smaller than the shallowest pits currently in use, but provides ample support to the apron.

As mentioned above, certain regulations require a certain length of apron, e.g. 750 mm. The length of vertical overlap between the apron and the elevator car door will depend on the depth of the pit and the size of the apron. To give an example, if the apron has a length of 750 mm and the pit has a depth of 300 mm then the elevator car door and the apron may overlap by around 400 mm or more (allowing a small distance between the bottom of the car and the bottom of the door). In less shallow pits (but still shallower than a full depth pit), the overlap may be at least 200 mm or at least 300 mm. Of course the apron length set by the regulations is a minimum requirement. A longer apron can block a larger portion of the hoistway during a rescue operation and therefore a longer apron (with a length greater than 750 mm, e.g. at least 1 m) may be desirable for improved safety. Therefore the overlap could be significantly more in such cases. The arrangement according to this disclosure generally permits an apron of greater length than the pit depth and therefore facilitates the use of longer aprons.

The apron may be provided with a chamfer at its lower edge (i.e. an angled part that is angled away from the landing, into the hoistway) as a further protective measure. In the event of unexpected movement of the elevator car during a rescue operation this chamfer may prevent a foot from becoming trapped and/or sheared between the elevator car and the landing.

According to another aspect of the present disclosure there is provided a method of operating an elevator car, wherein the elevator car comprises a door and an apron, the method comprising: as the elevator car approaches its lowest landing, the apron moving from a deployed position in which it hangs below the door to a retracted position in which it is vertically overlapped with the door and engaged with the door; and opening the door, and thereby moving the apron sideways together with the door.

It will be appreciated that all of the optional features described above in relation to the first aspect may also optionally be applied to the second aspect.

BRIEF DESCRIPTION OF THE DRAWINGS

Certain examples of the present disclosure will now be described, by way of example only, with reference to the accompanying drawings in which.

DETAILED DESCRIPTION OF THE INVENTION

Figure 1C:
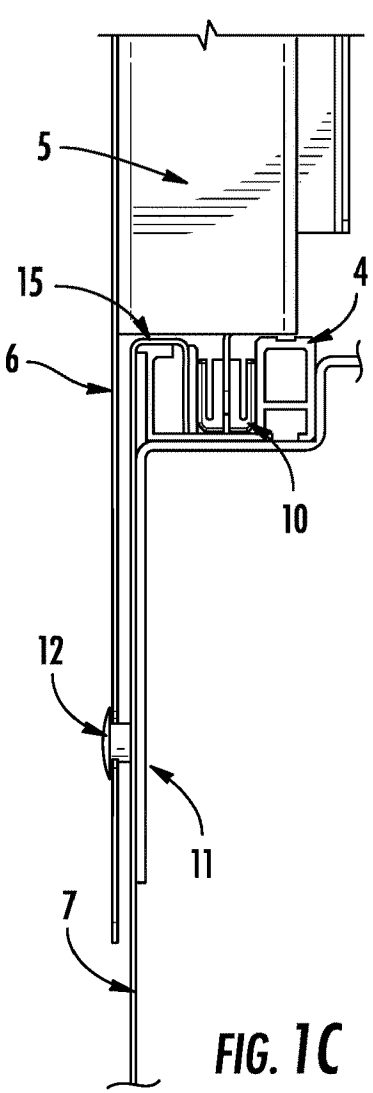
FIGS. 1*a*, 1*b* and 1*c* show an elevator car with an apron in a deployed position.
Figure 1B:
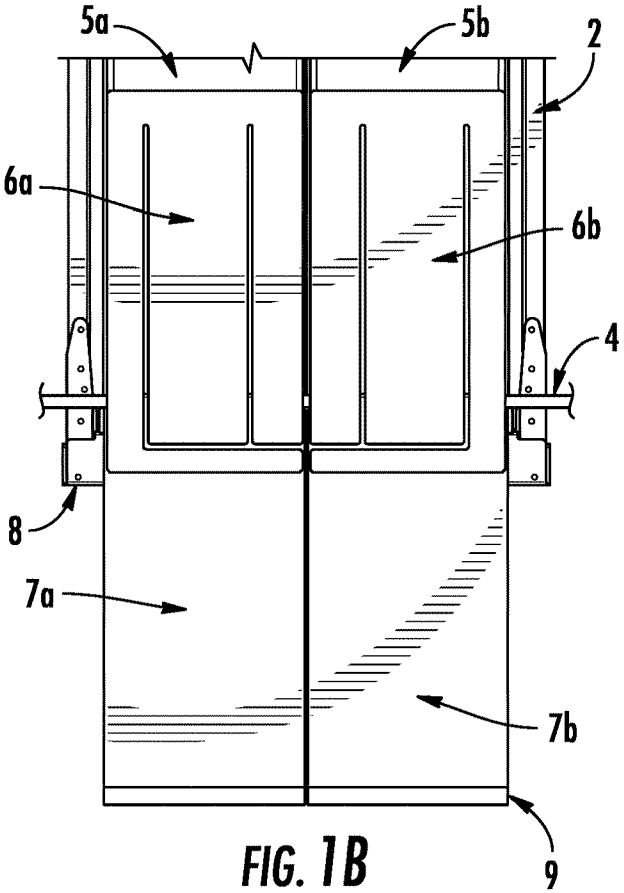
Figure 1A:
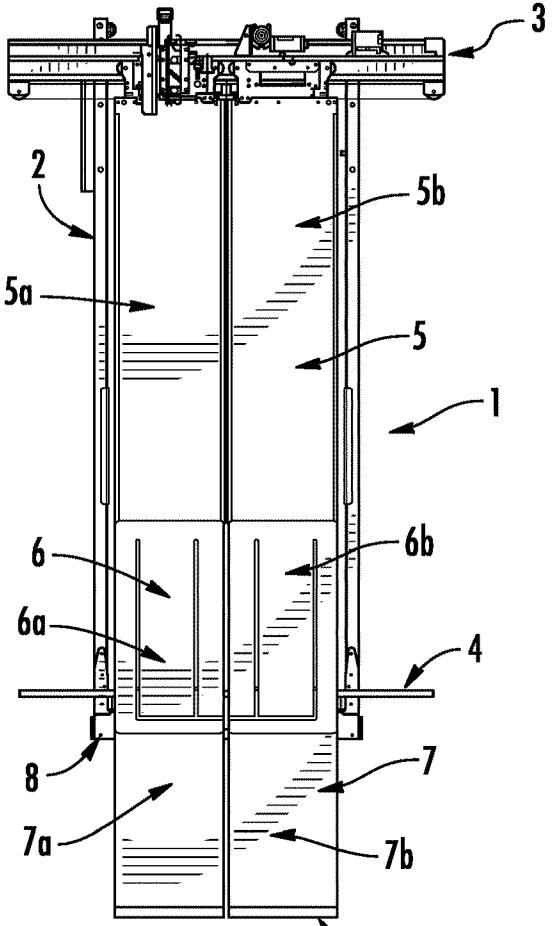

FIG. 1*a* shows an elevator car 1 that includes car uprights 2, car door rails 3, a car door sill 4, car door 5 (which in this example is a centre-opening door comprising a left door panel 5*a* and a right door panel 5*b*), a guiding panel 6 (also comprising a left guiding panel 6*a* and a right guiding panel 6*b*) and an apron 7 (also comprising a left apron panel 7*a* and a right guiding panel 7*b*).

The elevator car 1 is shown in FIG. 1*a* in a front view as if seen from an elevator landing, with the elevator door 5 closed. The bottom of the elevator car 1 is shown at 8. The apron 7 hangs down below the bottom 8 of the elevator car 1 by a distance of at least 750 mm as required by certain regulations. In the event of an emergency situation in which the elevator car 1 is stopped in the hoistway (not shown), but not level with the landing floor, passengers within the elevator car 1 may need to be rescued. In such a rescue, the elevator car door 5 can be opened so that the passengers can descend with a small drop to the landing floor below. During this procedure, the apron 7 is interposed between the landing and the hoistway so as to reduce the size of any gap underneath the elevator car 1 that would otherwise pose a risk to passengers or rescuers. The apron 7 reduces the possibility of someone falling into the hoistway. Additionally a chamfered part 9 is provided at the bottom of the apron 9 which will push any object (e.g. a foot) that is partially in the hoistway back to the landing if the elevator car 1 starts to descend.

FIG. 1*b* shows an enlarged view of the guiding panel 6 and apron 7.

FIG. 1*c* is a side view showing the vertical relationship between the door 5, the guiding panel 6 and the apron 7 when the apron 7 is in the deployed position. FIG. 1*c* also shows the door guide mechanism 10 by means of which the door 5 slides in the sill 4 and the rigid support structure 11 which hangs downwards from the sill 4 and adjacent to the apron 7 so as to provide a degree of support and rigidity to the apron 7 and hold it in a vertical position. The rigid support structure 11 is less than 300 mm long so that it can fit in even the shallowest of pits.

The cross-section of FIG. 1*c* also shows how the apron 7 is hooked over a portion of the sill 4. A hook 15 is formed at the upper edge of the apron 7 and hooks over a portion of the sill 4 so as to define the deployed position of the apron 7. In this position the weight of the apron 7 is supported by the sill 4 and the weight of the apron 7 holds it in this position.

FIGS. 1*a* and 1*b* also clearly show that the apron 7 in this example is divided into two separate apron parts: a left apron part 7*a* and a right apron part 7*b*. This is very different from a standard apron which is typically formed as a single piece, e.g. a single sheet of metal. In existing arrangements, even if the apron is split in some fashion, this is typically done to fold the apron underneath the car when not in use (e.g. to compress it in a shallow pit), but in such cases the apron's height is divided while each apron part retains its full width across the width of the doorway. In the example of FIGS. 1*a*-1*c* the apron is instead divided in width such that each apron part 7*a*, 7*b* has a width less than the full width of the doorway, each apron part 7*a*, 7*b* corresponding instead to a width of a respective door part 5*a*, 5*b*.

The arrangement shown in FIGS. 1*a*-1*c* is the arrangement during normal use of the elevator car 1 at any floor other than the lowest floor. In this arrangement the apron 7 is disposed very similarly to a standard apron and performs the same safety function in the same way.

Figure 2C:
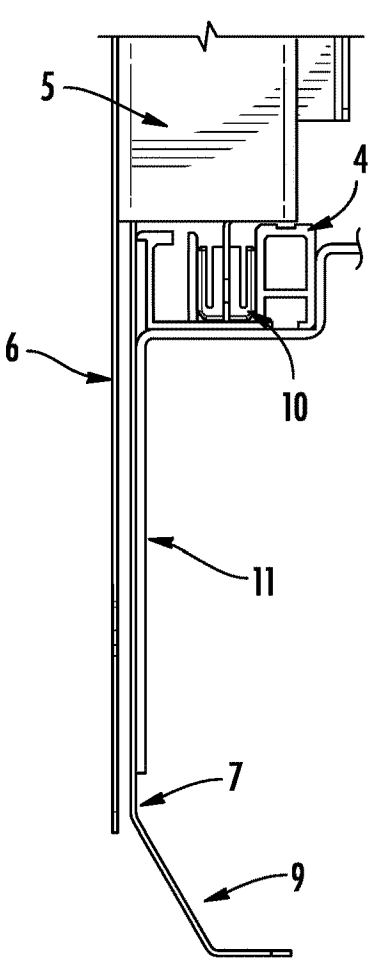
FIGS. 2*a*, 2*b* and 2*c* show an elevator car with an apron in a retracted position.
Figure 2B:
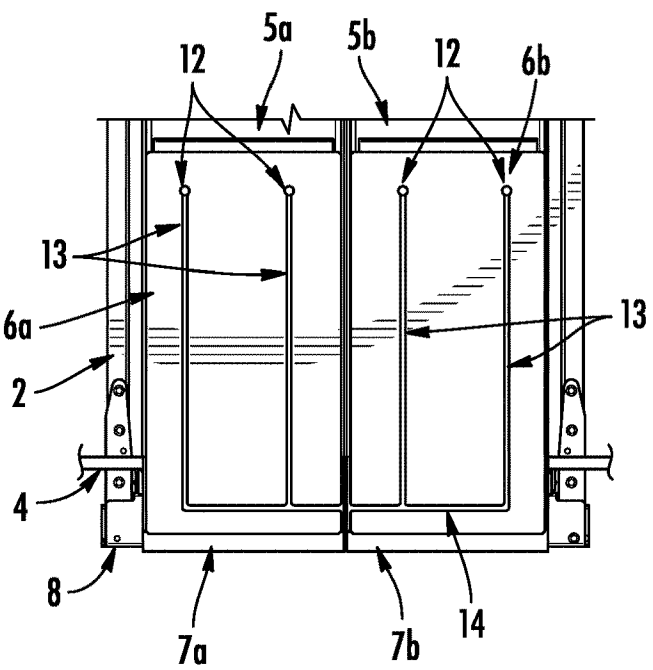
Figure 2A:
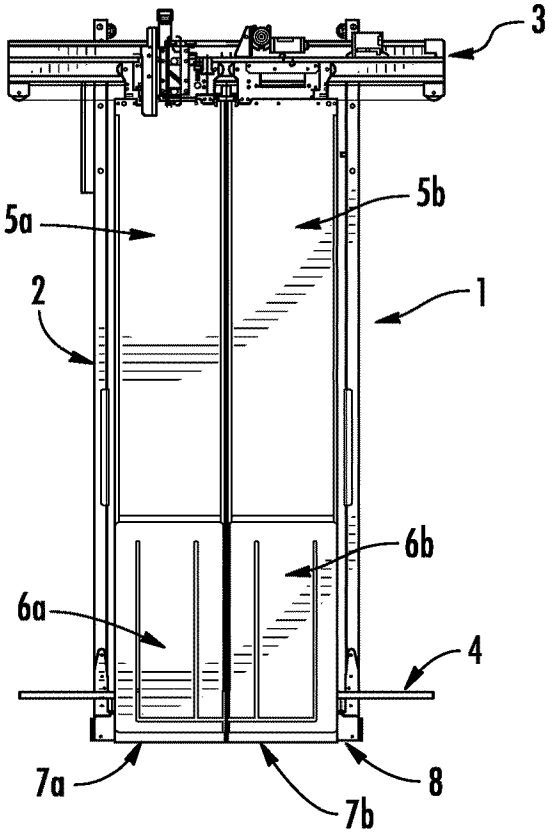

The arrangement shown in FIGS. 2*a*-2*c* shows where this example differs significantly from standard apron arrangements. FIGS. 2*a*-2*c* show an arrangement in which the apron 7 is vertically overlapped to a significant extent with the door 5. This arrangement arises in the case of a shallow pit which has a pit depth less than the length of the apron 7. In such cases the apron cannot be accommodated fully in the pit and therefore as the elevator car 1 descends to the lowest floor (e.g. to take on or deliver passengers to that floor) the bottom of the apron 7 comes into contact with the pit floor before the elevator car 1 has reached a position level with the lowest landing floor. As shown in FIGS. 2*a*-2*c*, in this situation the apron 7 is displaced upwardly relative to the elevator car 1 (or as viewed from the frame of reference of the building, the apron 7 remains stationary while the elevator car 1 continues to descend past it towards the pit). A comparison between FIG. 2*c* and FIG. 1*c* shows how, in the retracted position, the chamfered lower edge 9 of the apron 7 is much closer to the bottom of the elevator car 1 and the hook 15 at the upper edge of the apron 7 has risen up inside the elevator car door 5.

In this retracted position, the apron 7 overlaps vertically with the door 5 and therefore also overlaps the doorway that will be used by passengers to enter or exit the elevator car 1. However, in this retracted position, the apron panels 7*a*, 7*b* are each engaged with the respective guiding panels 6*a*, 6*b* which are in turn mounted on the respective door panels 5*a*, 5*b*. As shown in FIG. 2*b*, pins 12 attached to the apron panels 7*a*, 7*b* are engaged in vertical grooves (or slots) 13 of the guiding panels 6*a*, 6*b*. This engagement of the pins 12 in the grooves 13 ensures that any movement of the guiding panels 6*a*, 6*b* (which is caused by movement of the door panels 5*a*, 5*b*) will also cause movement of the apron panels 7*a*, 7*b*. Therefore as the door panels 5*a*, 5*b* open to allow passengers to enter and/or exit the elevator car 1, the apron panels 7*a*, 7*b* are moved out of the way so as to leave the doorway unobstructed. In this way the apron 7 of this disclosure can be of simple construction without requiring any complex folding mechanism, but is still compatible with a very low profile (i.e. shallow) hoistway pit.

Figure 3A:
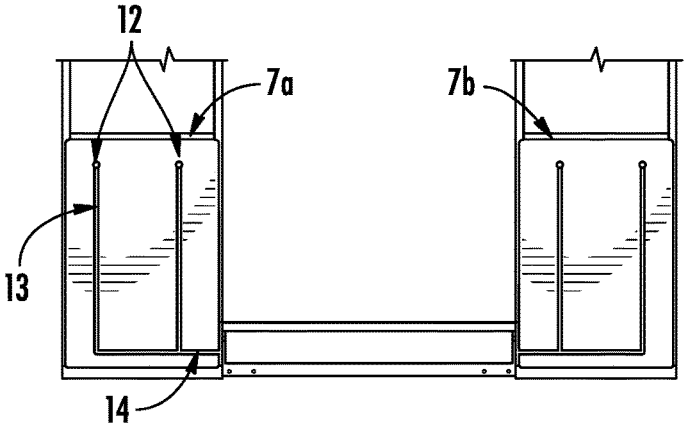
FIG. 3*a* shows an apron in the retracted position with the elevator car doors open.

FIG. 3*a* shows the arrangement of the apron parts 7*a*, 7*b* when the elevator car 1 is at the lowest floor in the hoistway, i.e. adjacent to the pit, with the apron 7 in the retracted position and with the elevator door 5 open. The separation of the left and right apron panels 7*a*, 7*b* can clearly be seen here with the fully open and unobstructed doorway for access to the car 1.

Another important aspect of this example is that the apron 7 should not be moved if the elevator car door 5 is opened at any floor other than the lowest floor. FIG. 3*c* shows such a situation. As can be seen here, the elevator car door 5 has been opened by separating the left door panel 5*a* and the right door panel 5*b*, but the left apron panel 7*a* and the right apron panel 7*b* have remained in place next to each other in the deployed position in which the apron panels 7*a*, 7*b* hang below the doorway. In normal operation (i.e. when the elevator car 1 is level with a landing) the apron 7 simply hangs out of sight and the elevator car door 5 operates as normal with the elevator car door 5 fully aligned with the landing door (not shown) and with no access to the hoistway possible. In a rescue situation, the elevator car door 5 can be opened even though the elevator car 1 is not level with a landing in order to allow passengers to leave the elevator car 1. In such a situation, where the elevator car 1 is above the landing to which passengers are exiting, the apron 7 in its deployed position as shown in FIG. 3*c*, obstructs access to the hoistway via the gap underneath the elevator car 1, thereby protecting the passengers and rescuers from falling into the hoistway.

As can be seen in FIG. 3*c*, the pins 12 on the apron 7, when the apron 7 is in the deployed position, are aligned with horizontal grooves (or slots) 14 in the guiding panels 6*a*, 6*b* attached to the door panels 5*a*, 5*b*. Thus, as the door panels 5*a*, 5*b* move apart, the groove 14 slides past the pins 12 without inducing any movement in the apron panels 7*a*, 7*b* and thus ensuring that the apron 7 remains in its protective deployed position.

Figure 3B:
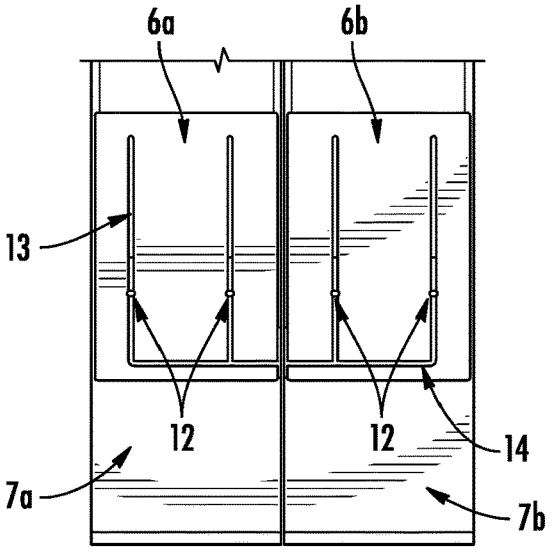
FIG. 3*b* shows an apron mid-way between a retracted position and a deployed position.
Figure 3C:
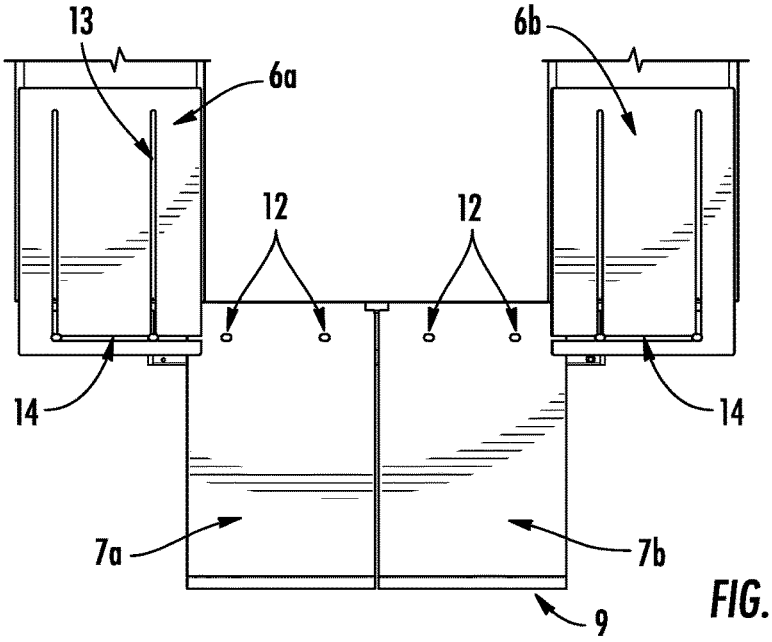
FIG. 3*c* shows an apron in the deployed position with the elevator car doors open.

FIG. 3*b* shows the apron 7 in an intermediate position between the fully deployed and fully retracted positions. The apron 7 is in the process of sliding into the elevator car door 5 and the pins 12 are in the process of sliding in the vertical grooves 13 of the guiding panel 6. The vertical grooves 13 are interconnected (optionally with rounded corners or chamfers as discussed above to accommodate a certain degree of misalignment) with the horizontal grooves 14 so that the pins 12 can transfer between the grooves 13, 14. In normal operation the pins 12 are mostly disposed in the horizontal grooves 14, but as the elevator car 1 approaches the lowest landing and the apron 7 rises into the door 5, the pins 12 transition from the horizontal grooves 14 into the vertical grooves 13 so as to engage the apron panels 7*a*, 7*b* with the guiding panels 6*a*, 6*b* and thereby the door panels 5*a*, 5*b* as described above.

It will be appreciated that many variations of this example are possible within the scope of the claims. For example the pins 12 could be provided on the guiding panel 6 with the grooves 13, 14 formed in the apron 7. Such an arrangement is generally less preferred as the strength and rigidity of the apron 7 is important and so it is preferred not to form grooves in it. Alternatively the pins or the grooves could be formed directly on the door panels 5*a*, 5*b* without any intervening guiding panel 6. Further, while pins and grooves (or slots) are one way to achieve the engagement between the apron 7 and the door 5, other engagement mechanisms are also possible such as rollers engaging with flanges. In such examples, the vertical extent of the flanges can be chosen so that they engage with rollers on the other part when the parts overlap (in the retracted position when it is desired to move them together), but when the apron is in the deployed position the rollers lie above or below the flanges so as not to engage therewith. It will also be appreciated that a similar arrangement may be used on telescoping doors where two door panels 5*a*, 5*b* retract towards the same side of the doorway. In such examples both apron panels 7*a*, 7*b* would also be retracted to the same side of the doorway. There may be a small depth offset between the two apron panels 7*a*, 7*b* in such arrangements (i.e. one is located slightly further into the hoistway from the landing), but not enough to create a risk to passengers. The functionality described above would otherwise apply equally.

Figure 4A:
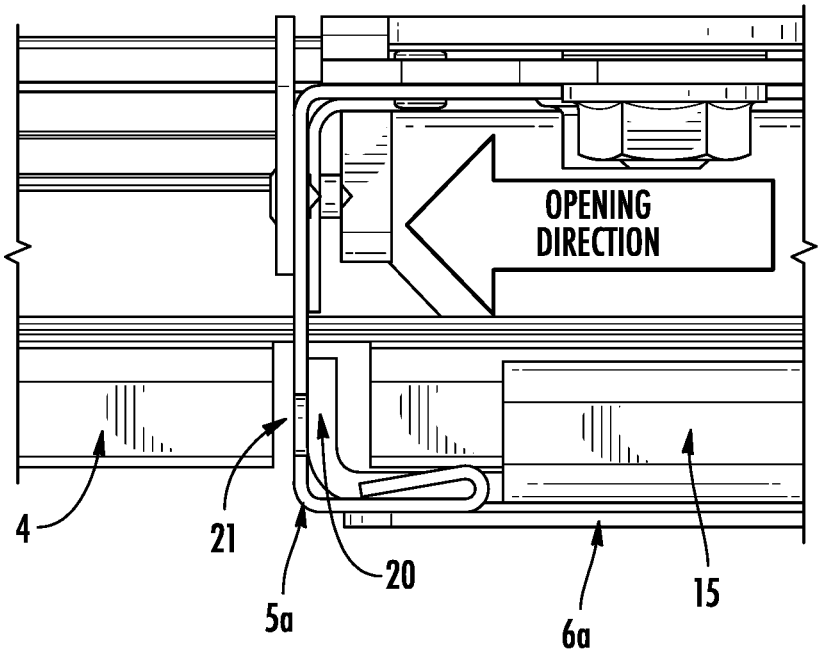
FIGS. 4*a* and 4*b* show an apron and door sill shaped for increased apron rigidity.
Figure 4B:
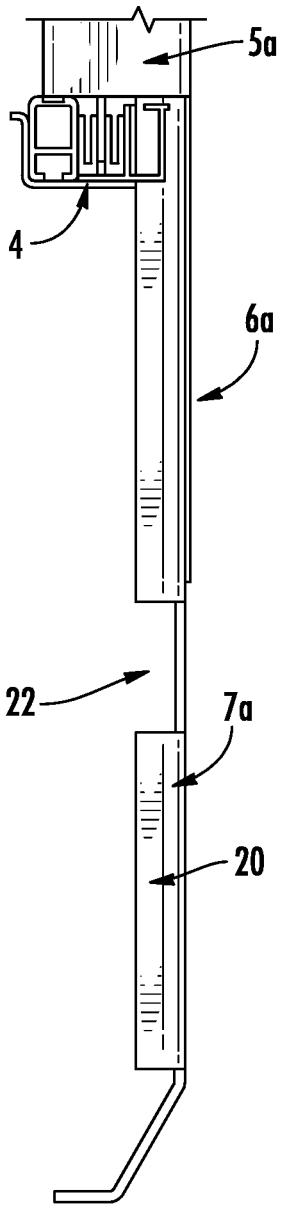

FIG. 4*a* shows an example of an apron panel 7*a* that has been shaped for increased rigidity. In this example, the rigidity of the apron panel 7*a* has been increased by providing a right-angle bend 20 at the outer side thereof. This bend 20 provides rigidity against bending perpendicular to the door 5 and thus maintains the apron panel 7*a* in a vertical position both in the deployed position (for increased safety) and also during movement from the deployed position to the retracted position (i.e. while in contact with the pit floor). In order to ensure that the apron panel 7*a* projects beyond the sill 4 by the minimum amount, the bend 20 is accommodated within the sill 4 by providing a sill slit 21 in the sill 4. The sill slit 21 allows the bend 20 of the apron panel 7*a* to slide vertically within the sill slit 21 during movement between the deployed position and the retracted position. Additionally, an apron slit 22 is provided in the bend 20 of the apron panel 7*a* that aligns with and can accommodate the sill 4 so that the bend 20 can slide over the sill 4 during elevator car door opening when the apron panel 7*a* is in the retracted position and moves together with the door panel 5*a*. The vertical position of the apron slit 22 in the bend 20 of the apron panel 7*a* will be determined by the depth of the pit so that it aligns with the sill 4 when the apron panel 7*a* is in contact with the pit floor and the elevator car 1 is positioned at the lowest floor.

Figure 5A:
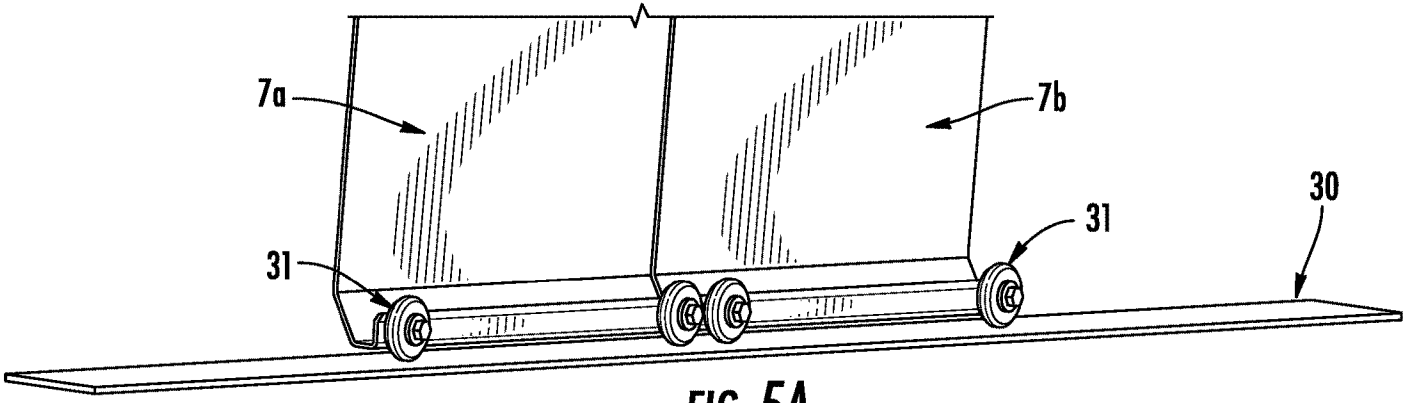
FIGS. 5*a*, 5*b* and 5*c* illustrate a first example of the use of rollers to reduce friction between the apron and the pit floor.
Figure 5B:
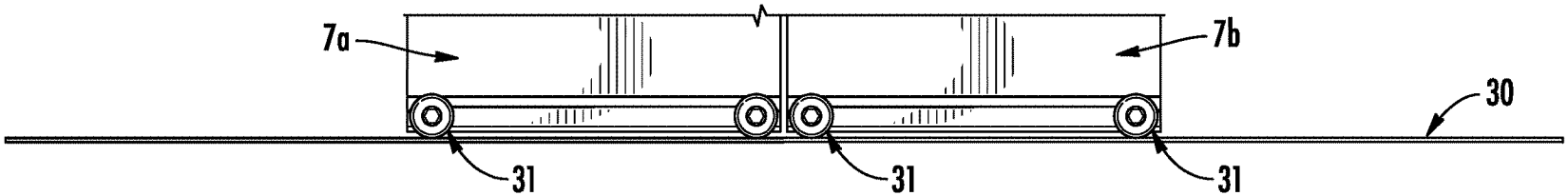
Figure 5C:
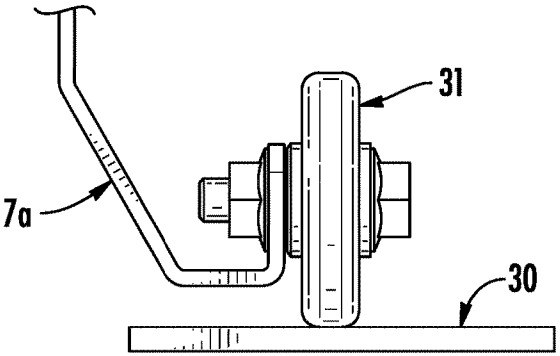

FIGS. 5*a*, 5*b* and 5*c* illustrate one example of the use of rollers 31 on the bottom of the apron 7 to reduce friction between the apron 7 and the pit floor 30 as the apron 7 moves during door opening and closing when in the retracted position. FIG. 5*a* is a perspective view, FIG. 5*b* is a front view and FIG. 5*c* is a side view. In this example the rollers 31 are affixed to the bottom edge of the apron panels 7*a* and 7*b* so that they are carried on the apron panels 7*a*, 7*b*. Throughout most of the height of the hoistway, the rollers 31 will simply hang freely from the bottom of the apron 7 while it is in the deployed position. However, when the car 1 approaches the lowest floor, the rollers 31 will come into contact with the pit floor 30 causing the apron 7 to move relative to the car 1 to the retracted position. As the elevator car door 5 opens, the rollers 31 will roll along the pit floor 30 with low friction.

Figure 6A:
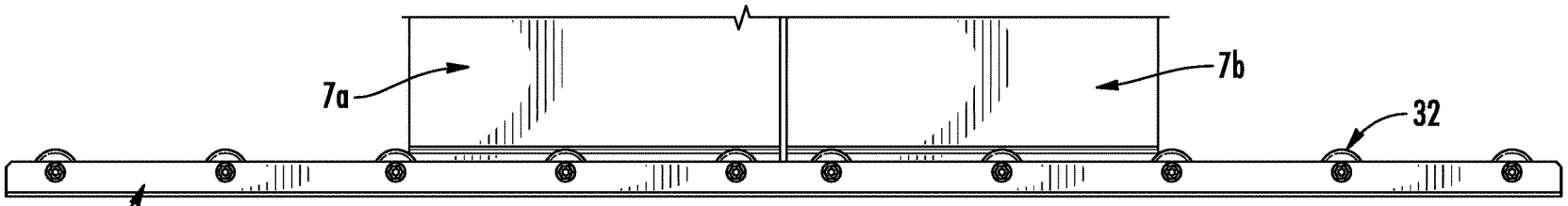
FIGS. 6*a*, 6*b* and 6*c* illustrate a second example of the use of rollers to reduce friction between the apron and the pit floor.
Figure 6B:
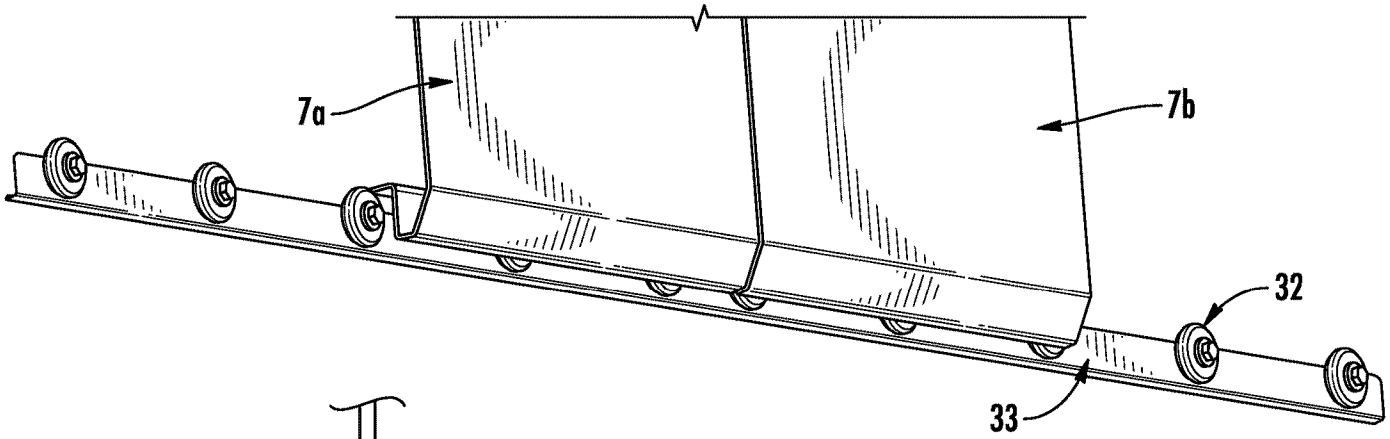
Figure 6C:
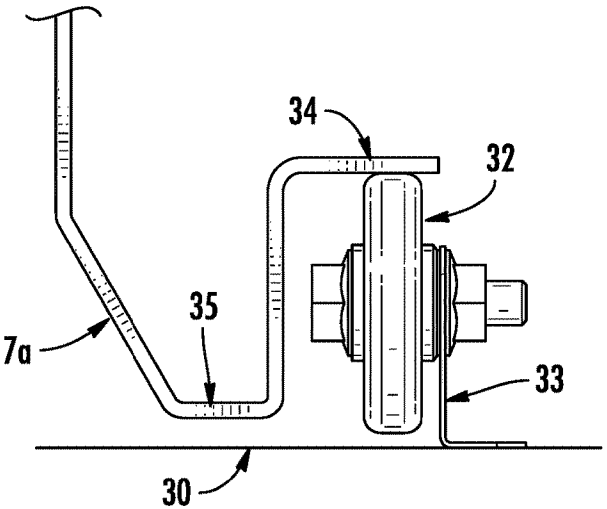

FIGS. 6*a*, 6*b* and 6*c* show an alternative arrangement of rollers 32 which provide similar functionality to the rollers 31 of FIGS. 5*a-c*, but are instead provided on the pit floor 30 so that they stay in place when the elevator car leaves the lowest floor and the apron moves to its deployed position. In this example the rollers 32 are mounted on a bracket 33 which is in turn mounted to the pit floor 30. Several rollers 32 are provided so that the full width of movement can be accommodated, ideally with the apron panels 7*a*, 7*b* always being supported on at least two rollers 32 each. The rollers may be positioned directly under the lowest part of the apron panels 7*a*, 7*b*. However, as shown in FIG. 6*c*, the apron panels 7*a*, 7*b* may be provided with an additional lip 34 arranged at a higher position than the bottom edge 35 of the apron 7 and arranged to extend horizontally for engagement with the top of the rollers 32 while preventing the bottom edge 35 of the apron 7 from contacting the pit floor 30. This allows the maximum length of apron 7 to be accommodated in the pit.

What is claimed is:

1. An elevator car comprising:

a door; and an apron movable between a deployed position and a retracted position;

wherein in the deployed position the apron hangs below the door;

wherein in the retracted position the apron is vertically overlapped with the door; and wherein in the retracted position the apron is engaged with the door such that it is movable sideways together with the door;

wherein the door comprises a first engagement part and wherein the apron comprises a second engagement part arranged to engage with the first engagement part when the apron is in the retracted position such that movement of the door in either direction causes corresponding movement of the apron.

2. An elevator car as claimed in claim 1, wherein in the deployed position the apron is disengaged from the door such that it will not move sideways together with the door.

3. An elevator car as claimed in claim 1, wherein the door comprises a first door panel and a second door panel and wherein the apron comprises a first apron panel and a second apron panel; and wherein in the retracted position the first apron panel is vertically overlapped with the first door panel and the second apron panel is vertically overlapped with the second door panel.

4. An elevator car as claimed in claim 3, wherein the first apron panel is arranged such that when it is in the retracted position it moves sideways together with the first door panel, and wherein the second apron panel is arranged such that when it is in the retracted position it moves sideways together with the second door panel.

5. An elevator car as claimed in claim 3, wherein the door is a centre-opening door in which the first door panel is movable to one side of the elevator car and the second door panel is movable to the other side of the elevator car during door opening.

6. An elevator car as claimed in claim 3, wherein the door is a telescoping door in which the first door panel and the second door panel are movable to the same side of the elevator car during door opening.

7. An elevator car as claimed in claim 1, wherein in the retracted position the apron is disposed at least partly inside the door.

8. An elevator car as claimed in claim 1, wherein in the deployed position the apron hooks onto a door sill underneath the door.

9. An elevator car as claimed in claim 1, wherein one of the first engagement part and the second engagement part comprises a pin and the other of the first engagement part and the second engagement part comprises a horizontal groove interconnected with a vertical groove; wherein the pin is slidably mounted in the grooves such that when the apron is in the deployed position the pin slides within the horizontal groove and such that when the apron moves between the deployed position and the retracted position the pin slides within the vertical groove.

10. An elevator car as claimed in claim 9, wherein the horizontal groove and the vertical groove are formed in a guiding plate attached to the elevator door.

11. An elevator car as claimed in claim 10, wherein the guiding plate is attached to the front of the door.

12. An elevator car as claimed in claim 1, wherein rollers are provided between the bottom of the apron and a pit floor.

13. An elevator car as claimed in claim 1, further comprising a rigid support structure extending downwardly from the bottom of the elevator car adjacent to the apron to provide support and rigidity to the apron in the deployed position, the rigid support structure extending downwardly from the elevator car by a distance less than 300 mm.

* * * * *